US011717947B2

(12) United States Patent
Huang

(10) Patent No.: US 11,717,947 B2
(45) Date of Patent: Aug. 8, 2023

(54) PRESS TOOL

(71) Applicant: SHIFUKANG INDUSTRIAL. CO., LTD., Taichung (TW)

(72) Inventor: Shang-Yuan Huang, Taichung (TW)

(73) Assignee: SHIFUKANG INDUSTRIAL. CO., LTD., Taichung (TW)

( * ) Notice: Subject to any disclaimer, the term of this patent is extended or adjusted under 35 U.S.C. 154(b) by 39 days.

(21) Appl. No.: 17/473,124

(22) Filed: Sep. 13, 2021

(65) Prior Publication Data

US 2023/0082887 A1 Mar. 16, 2023

(51) Int. Cl.
*B25B 27/06* (2006.01)
*B25B 28/00* (2006.01)

(52) U.S. Cl.
CPC ..... *B25B 27/062* (2013.01); *B25B 28/00* (2013.01)

(58) Field of Classification Search
CPC ..... B25B 5/067; B25B 5/082; B25B 5/101; B25B 27/062; B25B 28/00
USPC ..... 269/143, 249; 29/257, 276
See application file for complete search history.

(56) References Cited

U.S. PATENT DOCUMENTS 2,737,215 A * 3/1956 Larson ..... B25B 5/101 72/336
2,890,845 A * 6/1959 Kiekhaefer ..... F16B 33/006 411/908
11,052,519 B2 * 7/2021 Kirilichin ..... F16L 55/13
2009/0012753 A1 * 1/2009 Lionberg ..... B25B 5/101 703/1
2016/0158925 A1 * 6/2016 Robb, Jr. ..... F16C 17/10 29/257
2020/0346323 A1 * 11/2020 Gunn ..... F16L 3/11

FOREIGN PATENT DOCUMENTS

CN 112296934 A * 2/2021 ..... B25B 27/02

OTHER PUBLICATIONS

English translation of CN112296934A (Year: 2021).*

* cited by examiner

*Primary Examiner* — Lee D Wilson
*Assistant Examiner* — Sukwoo James Chang
(74) *Attorney, Agent, or Firm* — Muncy, Geissler, Olds & Lowe, P.C.

(57) ABSTRACT

A press tool is provided, including a base, a threaded shaft and an attachment member. The base has a head portion, a body portion and a foot portion. The head portion has a threaded hole. The foot portion has a through hole. The threaded shaft is movably screwed with the threaded hole. The threaded shaft has a first press portion configured for pushing an inner member received in a bushing disposed within a seat body. The pushing assembly is detachably disposed on the first pushing portion. The attachment member has a second press portion configured to press the bushing.

9 Claims, 9 Drawing Sheets

PRESS TOOL

BACKGROUND OF THE INVENTION

Field of the Invention

The present invention relates to a press tool.

Description of the Prior Art

Components are often connected by a variety of different connection structures such as socket-plug or male-female combination. In some circumstances, two components can rotate relatively, and it therefore requires shock-absorbing bushings or bearings to be disposed between the two components. To replace the components, the common way is that a tool is inserted into the hole to press the inner member and the tool is impacted to detach the inner member from the hole; however, it is very easy to damage the inner member and the inner surface of the hole.

The present invention is, therefore, arisen to obviate or at least mitigate the above-mentioned disadvantages.

SUMMARY OF THE INVENTION

The main object of the present invention is to provide a press tool which is configured to easily and stably detach members from a hole without damage thereto.

To achieve the above and other objects, a press tool configured to detach an inner member and a bushing from a receiving hole of a seat body is provided, wherein the bushing receives the inner member and is received in the receiving hole, and the press tool includes: a base, including a head portion, a body portion and a foot portion, the head portion and the foot portion being connected with the body portion and correspondingly separate in interval, the head portion including a threaded hole disposed therethrough, the foot portion including a through hole, a centroid position of the threaded hole and a centroid position of the body portion being located on a pressing direction; a threaded shaft, screwed with the threaded hole and movable in the pressing direction, including a first press portion, the first press portion being located between the threaded hole and the through hole and configured to press the inner member in the pressing direction to separate from the bushing and insert in the through hole; and an attachment member, detachably assembled to the first press portion, including a second press portion, the second press portion configured to press the bushing in the pressing direction to separate from the receiving hole and insert in the through hole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
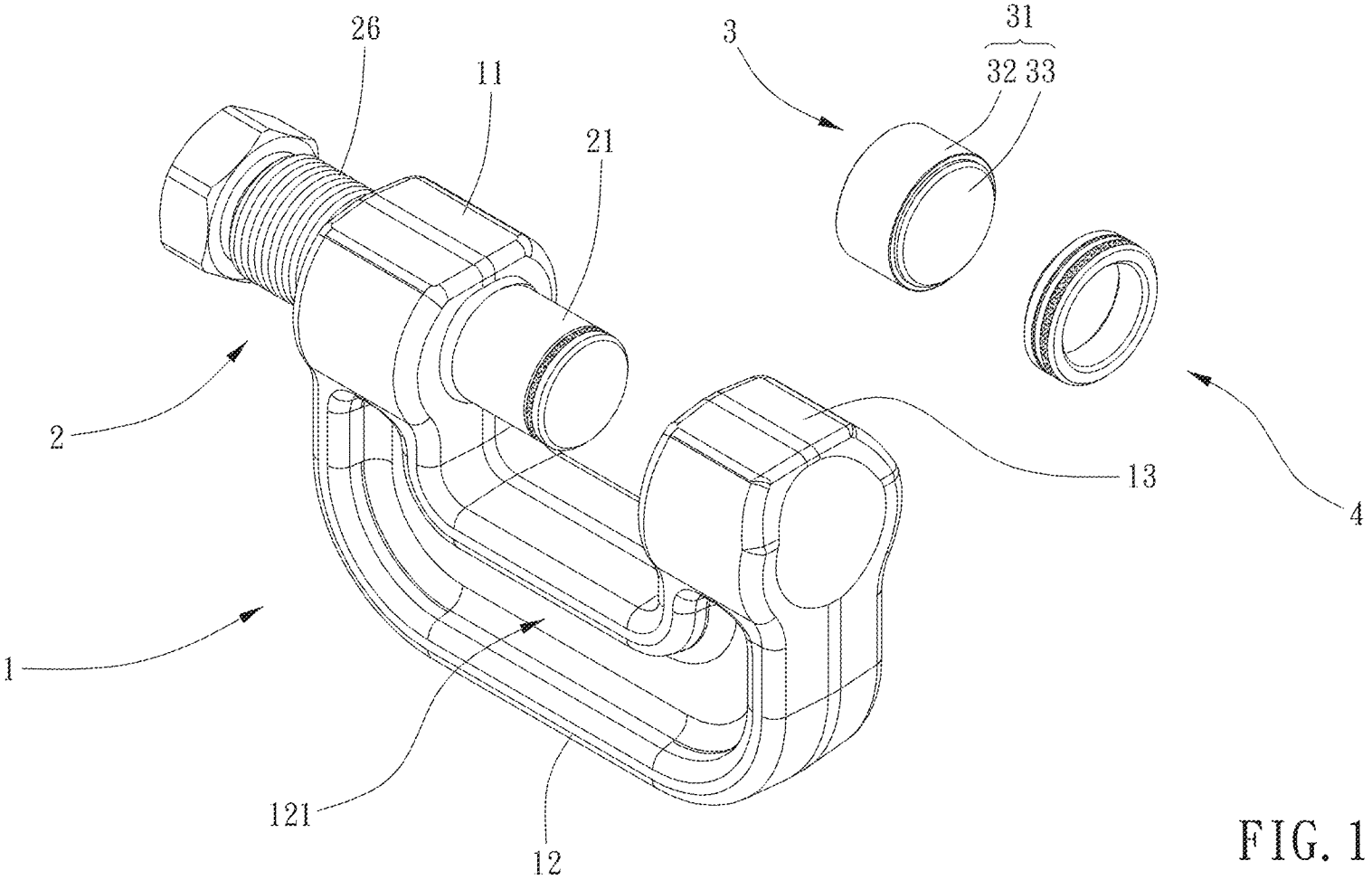
FIG. 1 is a stereogram of a preferable embodiment of the present invention.
Figure 2:
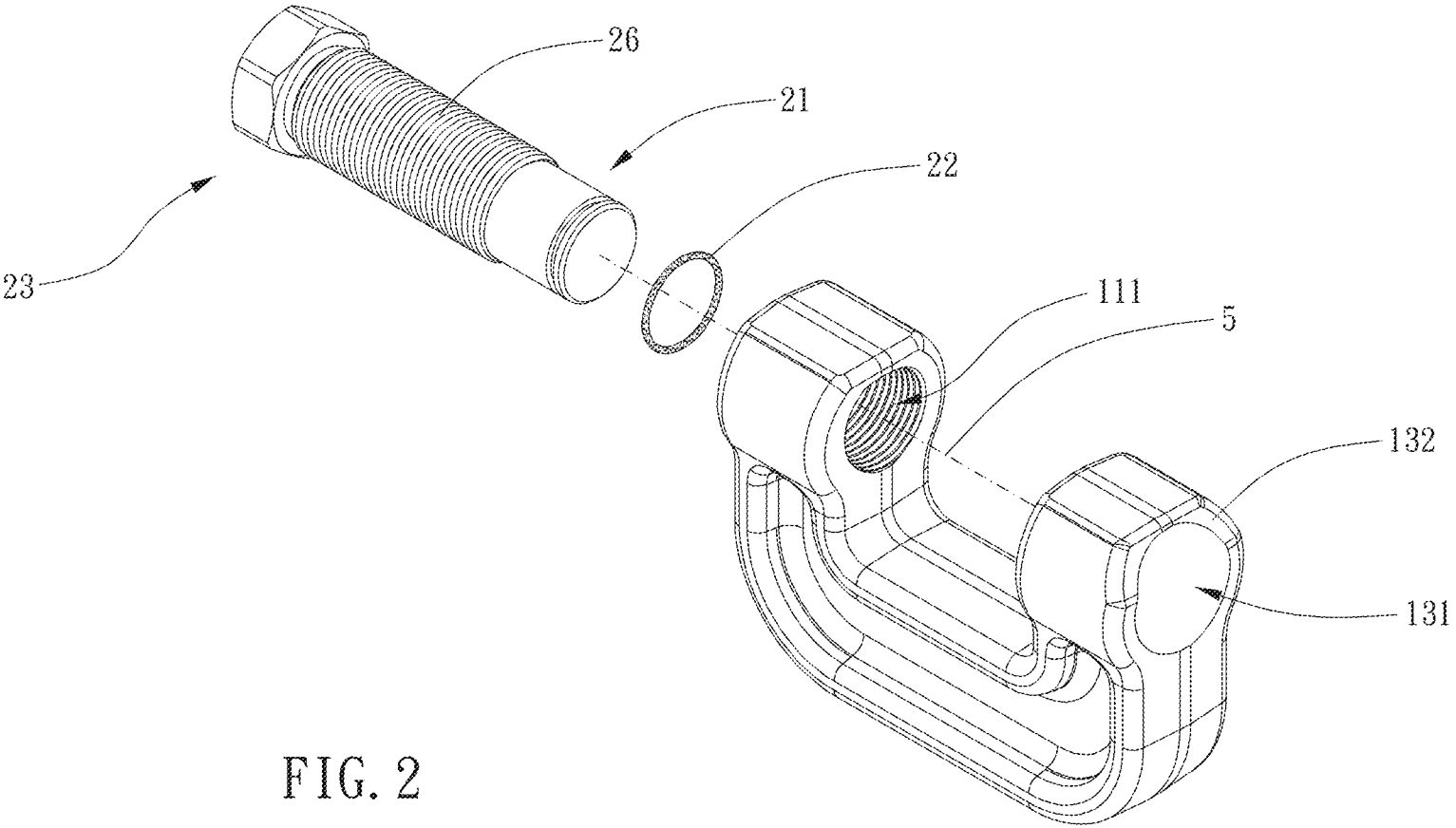
FIG. 2 is a breakdown drawing of a base and a threaded shaft of a preferable embodiment of the present invention.
Figure 3:
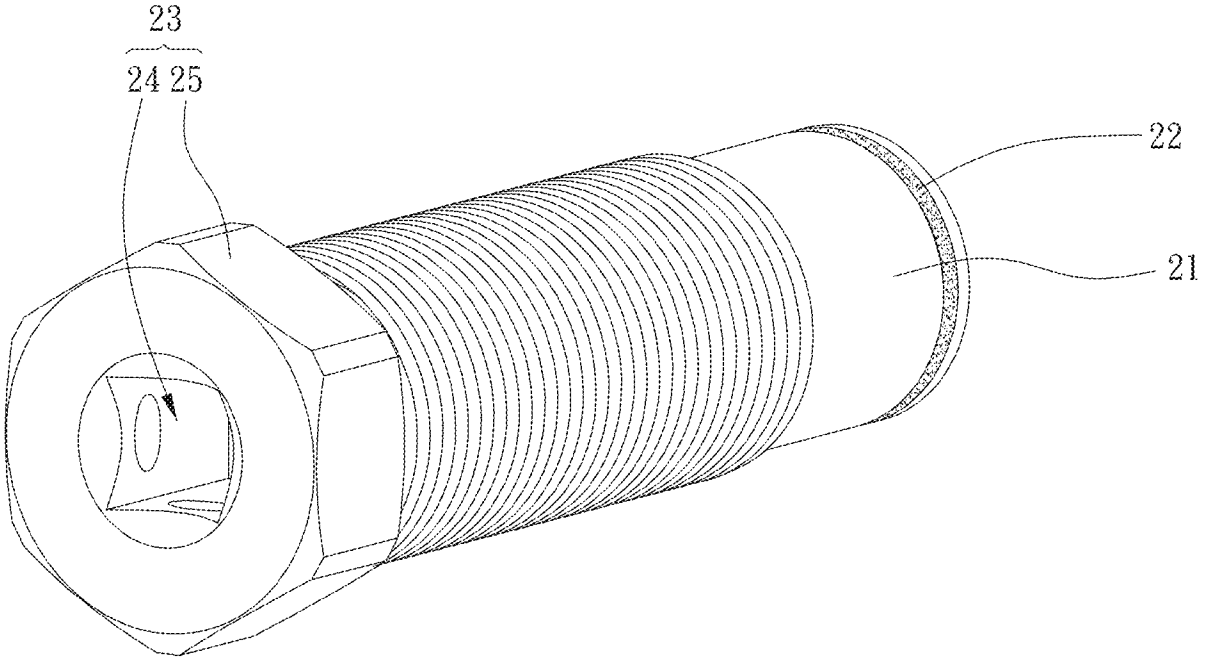
FIG. 3 is a stereogram of the threaded shaft of a preferable embodiment of the present invention.
Figure 4:
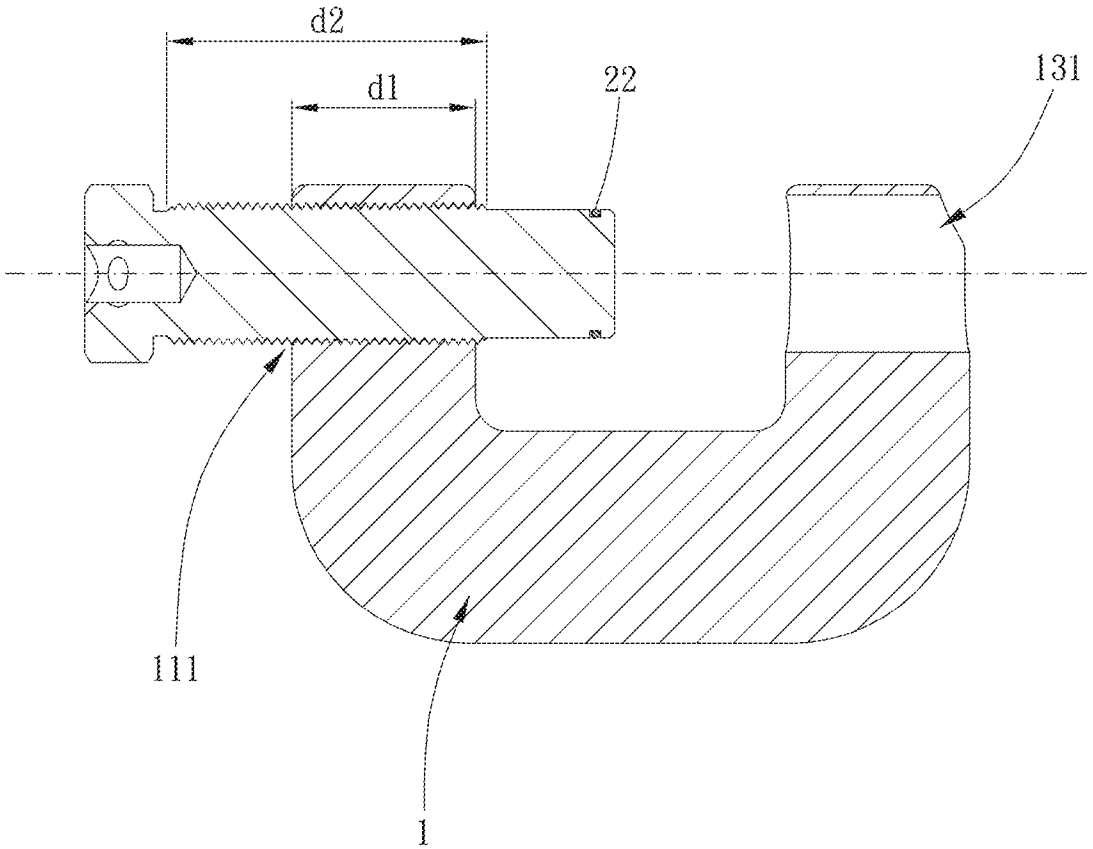
FIG. 4 is a cross-sectional view of the base and the threaded shaft of a preferable embodiment of the present invention.
Figure 5:
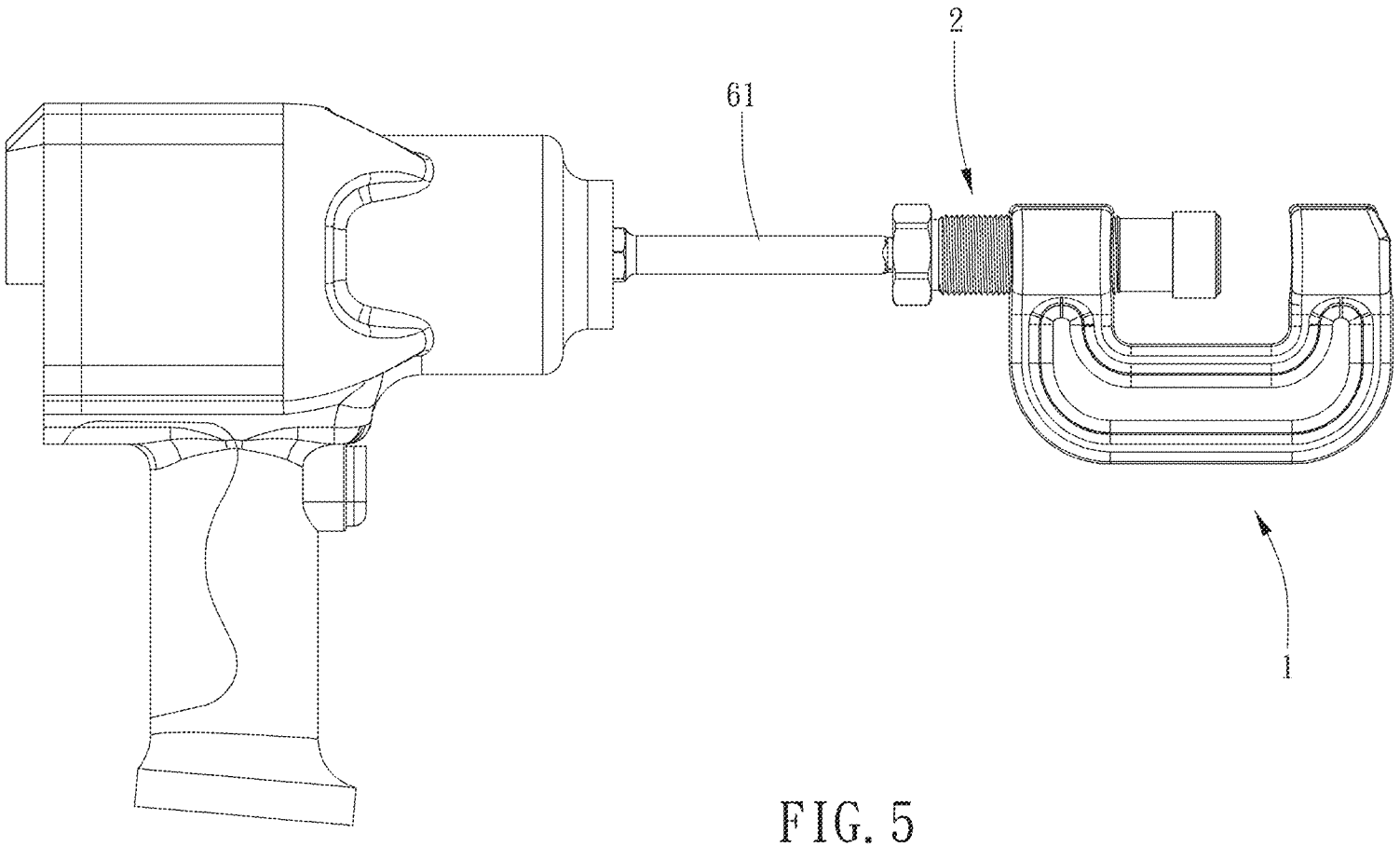
FIG. 5 is a drawing showing an application of a preferable embodiment of the present invention.
Figure 6:
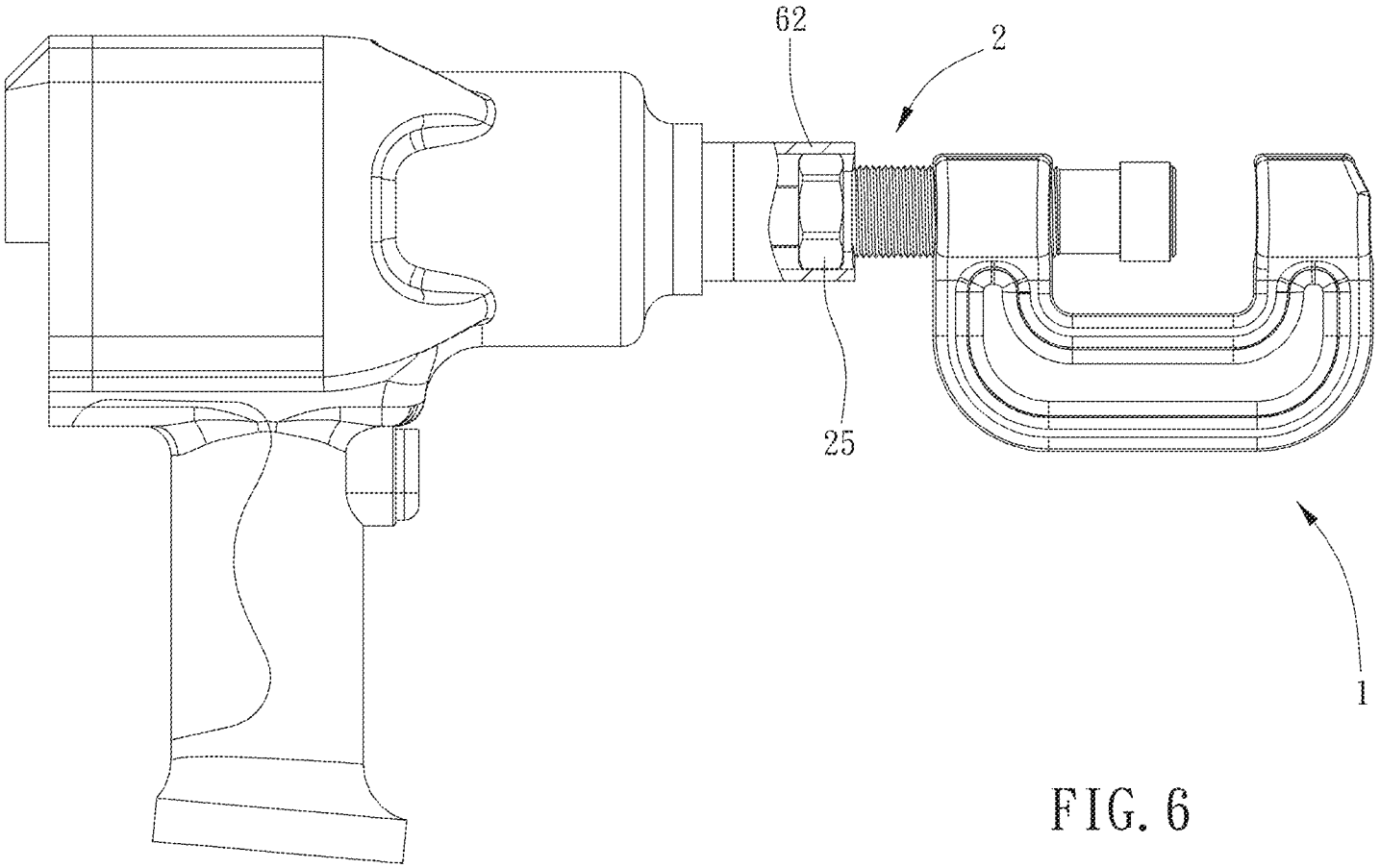
FIG. 6 is a drawing showing another application of a preferable embodiment of the present invention.
Figure 7:
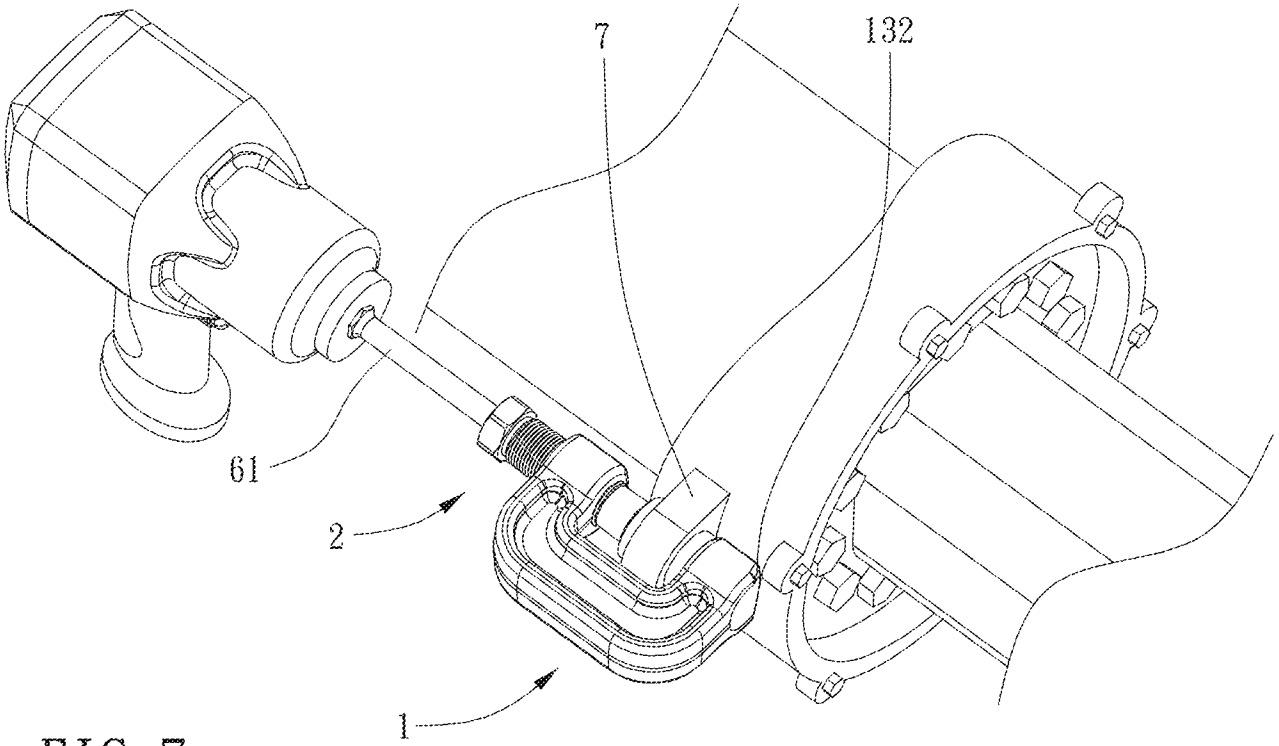
FIG. 7 is a drawing showing operation of a preferable embodiment of the present invention.
Figure 8:
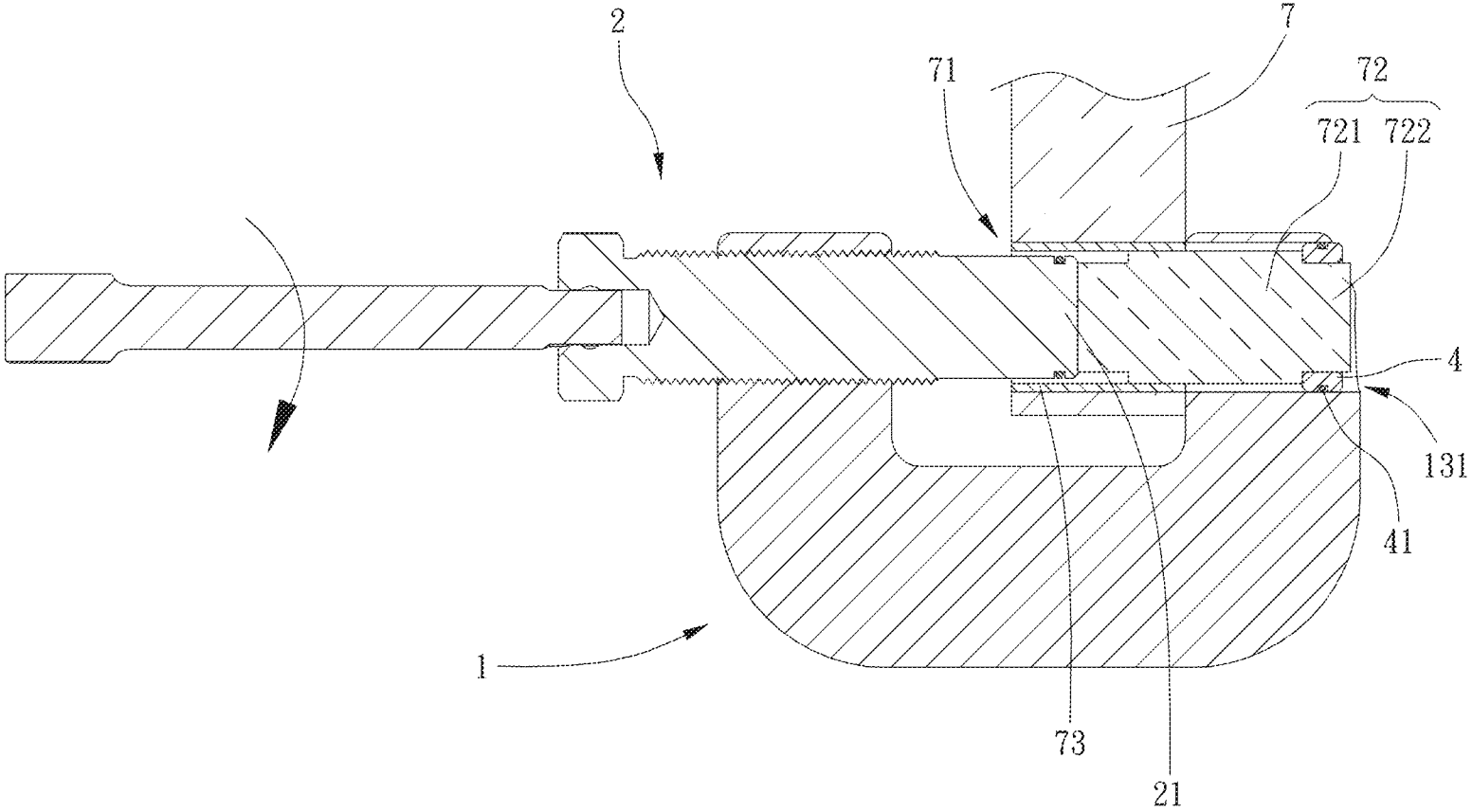
FIG. 8 is a drawing showing an inner member pressed by a first press portion according to a preferable embodiment of the present invention.
Figure 9:
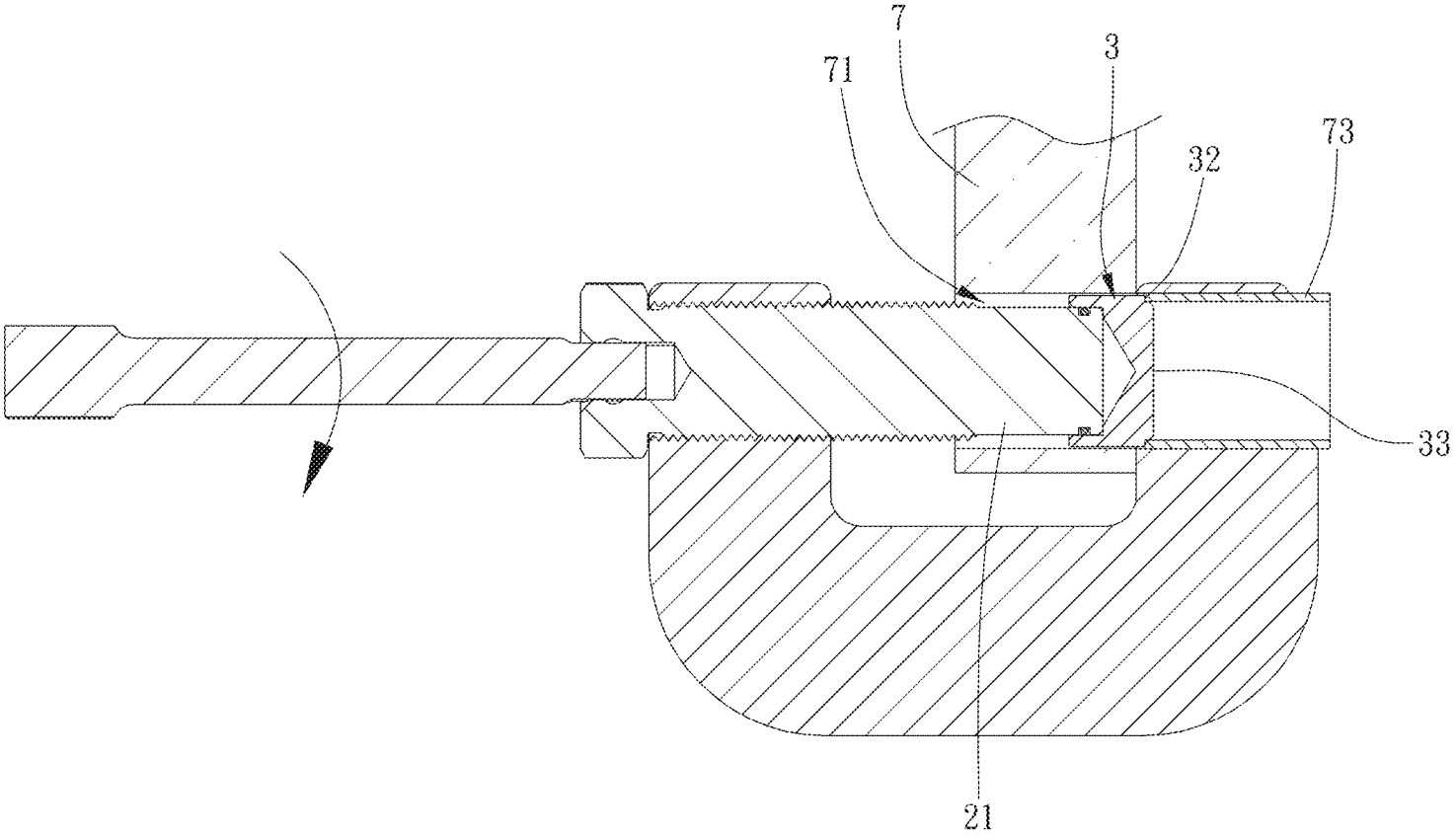
FIG. 9 is a drawing showing a bushing pressed by a second press portion according to a preferable embodiment of the present invention.

Please refer to FIGS. 1 to 9 for a preferable embodiment of the present invention. A press tool of the present invention is configured to detach an inner member 72 and a bushing 73 from a receiving hole 71 of a seat body 7, wherein the bushing 73 receives the inner member 72 and is received in the receiving hole 71. The press tool includes a base 1, a threaded shaft 2 and an attachment member 3.

The base 1 includes a head portion 11, a body portion 12 and a foot portion 13, the head portion 11 and the foot portion 13 are connected with the body portion 12 and correspondingly separate in interval, the head portion 11 includes a threaded hole 111 disposed therethrough, the foot portion 13 includes a through hole 131, and a centroid position of the threaded hole 111 and a centroid position of the body portion 12 is located on a pressing direction 5. In this embodiment, the threaded hole 111 is circular, the through hole 131 is circular, and an inner diametric dimension of the through hole 131 is larger than an inner diametric dimension of the threaded hole 111.

The threaded shaft 2 is screwed with the threaded hole 111 and movable in the pressing direction 5. Specifically, a ratio of an extent d2 of a threaded section 26 of the threaded shaft 2 and an extent d1 of the threaded hole 111 is 1.5 to 1.7. The threaded shaft 2 includes a first press portion 21, and the first press portion 21 is located between the threaded hole 111 and the through hole 131 and configured to press the inner member 72 in the pressing direction 5 to separate from the bushing 73 and insert in the through hole 131. Specifically, the first press portion 21 is disposed at one end of the threaded shaft 2, and a driving portion 23 is disposed at another end of the threaded shaft 2. The driving portion 23 includes an inner adaption hole 24 and an outer adaption portion 25, the inner adaption hole 24 is configured for insertion of a first connection member 61, and the outer adaption portion 25 is polygonal and configured to be inserted within a second connection member 62, so that the driving portion 23 can be driven by different driving tools. The attachment member 3 is detachably assembled to the first press portion 21, the attachment member 3 includes a second press portion 31, and the second press portion 31 is configured to press the bushing 73 in the pressing direction 5 to separate from the receiving hole 71 and insert in the through hole 131.

In detaching the inner member and the bushing, the foot portion 13 is abutted against the seat body 7, the inner member 72 is pressed by the first press portion 21, and the bushing 73 is then pressed by the second press portion 31. The two-stage pressing process makes the inner member 72 and the bushing 73 separate after the inner member 72 and the bushing 73 are detached, or it is optional to merely detach the inner member 72. In installing the inner member and the bushing, the inner member 72 and the bushing 73 are disposed at a side of the seat body 7 facing toward the head portion 11, and the threaded shaft 2 is then rotated to move to press the inner member 72 and the bushing 73 into the receiving hole 71 of the seat body 7, respectively.

In this embodiment, the second press portion 31 includes a pressing face 32 and an engagement portion 33, the engagement portion 33 is protrusive beyond the pressing face 32, the pressing face 32 is configured to be abutted against an end face of the bushing 73, and the engagement portion 33 is configured to be inserted within the bushing 73 (preferably, the engagement portion 33 is abutted radially against the inner surface of the bushing 73), which improves stability of pressing the bushing 73.

Preferably, the attachment member 3 is positionably sleeved on the first press portion 21, which is easy to assemble and disassemble and facilitates installation and uninstallation of the inner member 72 and the bushing 73.

Preferably, the press tool further includes a first frictional ring element 22 (such as a rubber ring), and the first frictional ring element 22 is disposed on at least one of an outer circumferential surface of the first press portion 21 and an inner circumferential of the attachment member 3. In this embodiment, the first frictional ring element 22 is inlaid within the outer circumferential surface of the first press portion 21, and when the attachment member 3 is disposed on the first press portion 21, the first frictional ring element 22 is pressed between the attachment member 3 and the first press portion 21. The first frictional ring element 22 can enhances combination of the attachment member 3 and the first press portion 21.

The press tool further includes a sleeve member 4, the inner member 72 includes a main body 721 and at least one projection 722, the at least one projection 722 projects axially from an end of the main body 721, and a largest outer diametric dimension of the main body 721 and a largest outer diametric dimension of the at least one projection 722 are smaller than the inner diametric dimension of the through hole 131. The sleeve member 4 is configured to receive the at least one projection 722 so that the sleeve member 4 is radially abuttable against an inner surface of the through hole 131 when the sleeve member 4 and the inner member 72 move into the through hole 131. The sleeve member 4 can compensate the gap between the inner member 72 and the through hole 131, which stabilizes movement of the inner member 72 during detachment. In this embodiment, the at least one projection includes two projections 722, and the two projections 722 extend from opposing sides of the main body 721, respectively.

Preferably, the press tool further includes a second frictional ring element 41, the second frictional ring element 41 is inlaid within an outer circumferential surface of the sleeve member 4, and when the sleeve member 4 moves into the through hole 131, the second frictional ring element 41 is pressed between the sleeve member 4 and the inner surface of the through hole 131, which stabilizes the movement of detached member.

The base 1 is preferably a forged solid metal member, so it is strong and durable. Two sides of the body portion 12 which are perpendicular to the pressing direction 5 each have a recess 121, and the recess 121 is configured for easy grip of the hand. A side of the foot portion 13 opposite to the head portion 11 includes an inclined face 132 which is tilted to the pressing direction.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A press tool, configured to detach an inner member and a bushing from a receiving hole of a seat body, the bushing receiving the inner member and being received in the receiving hole, the press tool including:

a base, including a head portion, a body portion and a foot portion, the head portion and the foot portion being connected with the body portion and correspondingly separate in interval, the head portion including a threaded hole disposed therethrough, the foot portion including a through hole, a centroid position of the threaded hole and a centroid position of the body portion being located on a pressing direction;

a threaded shaft, screwed with the threaded hole and movable in the pressing direction, including a first press portion, the first press portion being located between the threaded hole and the through hole and configured to press the inner member in the pressing direction to separate from the bushing and insert in the through hole; and an attachment member, detachably assembled to the first press portion, including a second press portion, the second press portion configured to press the bushing in the pressing direction to separate from the receiving hole and insert in the through hole;

wherein the attachment member has an outer diametric dimension smaller than an inner diametric dimension of the through hole and is movable through the through hole;

wherein the press tool further includes a sleeve member, the sleeve member is configured to receive a portion of the inner member and be radially abutted against an inner surface of the through hole, and the sleeve member has an outer diametric dimension smaller than the inner diametric dimension of the through hole and is movable through the through hole;

wherein the sleeve member has an inner diametric dimension smaller than the outer diametric dimension of the attachment member.

2. The press tool of claim 1, wherein the first press portion is disposed at one end of the threaded shaft, a driving portion is disposed at another end of the threaded shaft, the driving portion includes an inner adaption hole and an outer adaption portion, the inner adaption hole is configured for insertion of a first connection member, and the outer adaption portion is polygonal and configured to be inserted within a second connection member.

3. The press tool of claim 1, wherein the attachment member is positionably sleeved on the first press portion.

4. The press tool of claim 3, further including a first frictional ring element, wherein the first frictional ring element is disposed on one of an outer circumferential surface of the first press portion of the threaded shaft and an inner circumferential surface of the attachment member, and when the attachment member is disposed on the first press portion of the threaded shaft, the first frictional ring element is pressed between the attachment member and the first press portion.

5. The press tool of claim 4, wherein the first press portion is disposed at one end of the threaded shaft, a driving portion is disposed at another end of the threaded shaft, the driving portion includes an inner adaption hole and an outer adaption portion, the inner adaption hole is configured for insertion of a first connection member, and the outer adaption portion is polygonal and configured to be inserted within a second connection member; a side of the foot portion opposite to the head portion includes an inclined face which is tilted to the pressing direction; the base is a forged solid metal member; the second press portion includes a pressing face and an engagement portion, the engagement portion is protrusive beyond the pressing face, the pressing face is configured to be abutted against an end face of the bushing, and the engagement portion is configured to be inserted within the bushing; the press tool further includes a sleeve member and a second frictional ring element, the inner member includes a main body and at least one projection, the at least one projection projects axially from an end of the main body, a largest outer diametric dimension of the main body and a largest outer diametric dimension of the at least one projection are smaller than an inner diametric dimension of the through hole, the sleeve member is configured to receive the at least one projection so that the sleeve member is radially abuttable against an inner surface of the through hole when the sleeve member and the inner member move into the through hole, the second frictional ring element is inlaid within an outer circumferential surface of the sleeve member, and when the sleeve member moves into the through hole, the second frictional ring element is pressed between the sleeve member and the inner surface of the through hole; two sides of the body portion of the base which are perpendicular to the pressing direction each have a recess; the inner diametric dimension of the through hole is larger than an inner diametric dimension of the threaded hole; a ratio of an extent of a threaded section of the threaded shaft and an extent of the threaded hole is 1.5 to 1.7; the threaded hole is circular, and the through hole is circular; the at least one projection of the inner member includes two projections, the two projections extend from opposing sides of the main body, respectively; and the first frictional ring element is inlaid within the outer circumferential surface of the first press portion.

6. The press tool of claim 1, wherein a side of the foot portion of the base opposite to the head portion includes an inclined face which is tilted to the pressing direction.

7. The press tool of claim 1, wherein the base is a forged solid metal member.

8. The press tool of claim 1, wherein the second press portion of the attachment member includes a pressing face and an engagement portion, the engagement portion is protrusive beyond the pressing face, the pressing face is configured to be abutted against an end face of the bushing, and the engagement portion is configured to be inserted within the bushing.

9. The press tool of claim 1, further including a second frictional ring element, wherein the second frictional ring element is inlaid within an outer circumferential surface of the sleeve member, and when the sleeve member moves into the through hole, the second frictional ring element is pressed between the sleeve member and the inner surface of the through hole.

* * * * *